United States Patent [19]

Boulanger

[11] 4,163,125

[45] * Jul. 31, 1979

[54] PUSHBUTTON KEYBOARD SYSTEM

[75] Inventor: Henry J. Boulanger, Cumberland, R.I.

[73] Assignee: Texas Instruments Incorporated, Dallas, Tex.

[ * ] Notice: The portion of the term of this patent subsequent to Apr. 3, 1990, has been disclaimed.

[21] Appl. No.: 492,670

[22] Filed: Jul. 29, 1974

Related U.S. Application Data

[62] Division of Ser. No. 347,026, Apr. 2, 1973, Pat. No. 3,858,202, which is a division of Ser. No. 148,503, Jun. 1, 1971, Pat. No. 3,725,907.

[51] Int. Cl.[2] ..... H01H 13/70

[52] U.S. Cl. ..... 200/5 A; 200/159 B; 200/302

[58] Field of Search ..... 200/5 A, 159 B, 302

[56] References Cited

U.S. PATENT DOCUMENTS 3,749,859 7/1973 Webb et al. ..... 200/5 A X 3,941,953 3/1976 Misson et al. ..... 200/5 A X

*Primary Examiner*—James R. Scott

*Attorney, Agent, or Firm*—John A. Haug; James P. McAndrews

[57] ABSTRACT

A keyboard system has an insulating support having a first surface on which conductive paths are arranged. A plurality of spaced sets of U-shaped conductive members are arranged at an opposite surface of the support in electrical communication with first portions of the conductive paths and U-shaped contact members are associated with the sets of conductive members on said opposite surface of the support in electrical communication with second portions of the conductive paths. A plurality of selectively actuable conductive elements are provided in continuous electrical contact with respective sets of conductive members in disengagement with the associated contact members to be selectively deflected into engagement with selected contact members to establish bridging electrical connection between the selected conductive members and contact members for electrically connecting first and second preselected portions of the conductive paths.

3 Claims, 7 Drawing Figures

PUSHBUTTON KEYBOARD SYSTEM

This is a division of application Ser. No. 347,026, filed Apr. 2, 1973, which application Ser. No. 347,026 is a division of application Ser. No. 148,503 filed June 1, 1971, now U.S. Pat. No. 3,725,907, issued Apr 3, 1973.

BACKGROUND OF THE INVENTION

1. Field of the Invention

The present invention relates generally to keyboard systems and more particularly is directed to an improved pushbutton keyboard system for establishing electrical connections in response to actuation.

2. Description of Prior Art

In recent years numerous types of keyboard systems have been developed for use in transmitting coded electrical information for incorporation in various types of business machines such as electronic calculators. Typically such keyboard systems utilize pushbutton member appropriately symbolized in a manner indicative of a numeric or mathematical function generated in response to depression of the pushbutton member to establish electrical connections between various conductive paths and/or various circuit elements coupled to the system in order to achieve a desired function. However, particularly as the cost of associated equipment has decreased dramatically in recent years coupled with an increase in the use and availability of various devices incorporating such systems the need has arisen for extremely inexpensive readily manufacturable keyboard systems which may be economically and accurately produced on a mass production basis with a high degree of accurate repeatability. For example, the need for miniaturized electronic calculators, units for addressing computer systems, credit cards verifiers, etc. which necessarily require various types of keyboard arrangements has enormously increased in recent years requiring the provision of inexpensive and extremely durable keyboard systems which may be manufactured in a simple and economical manner on a relatively large volume basis. Particularly, in the computer field the need for durable, inexpensive keyboard systems which can accurately address electrical information either directly to a system or through a remote terminal or the like, while occupying a minimal amount of space, has become increasingly urgent.

Accordingly, it is an object of the present invention to provide an improved keyboard system adapted for selectively establishing electrical interconnections in response to mechanical actuation.

It is another object of the present invention to provide an improved pushbutton keyboard system in which actuation of individual pushbutton members establishes positive electrical interconnections for transmitting electrical information.

It is a further object of the present invention to provide an improved miniaturized pushbutton keyboard system which is relatively rugged and durable and which is extremely economical to fabricate on a mass production basis, and which is adapted for incorporation in various devices, such as electronic calculators, computer systems, etc.

BRIEF DESCRIPTION OF THE DRAWINGS

Various additional objects and advantages of the present invention will become readily apparent from the following detailed description and accompanying drawings wherein.

DESCRIPTION OF PREFERRED EMBODIMENTS

Figure 1:
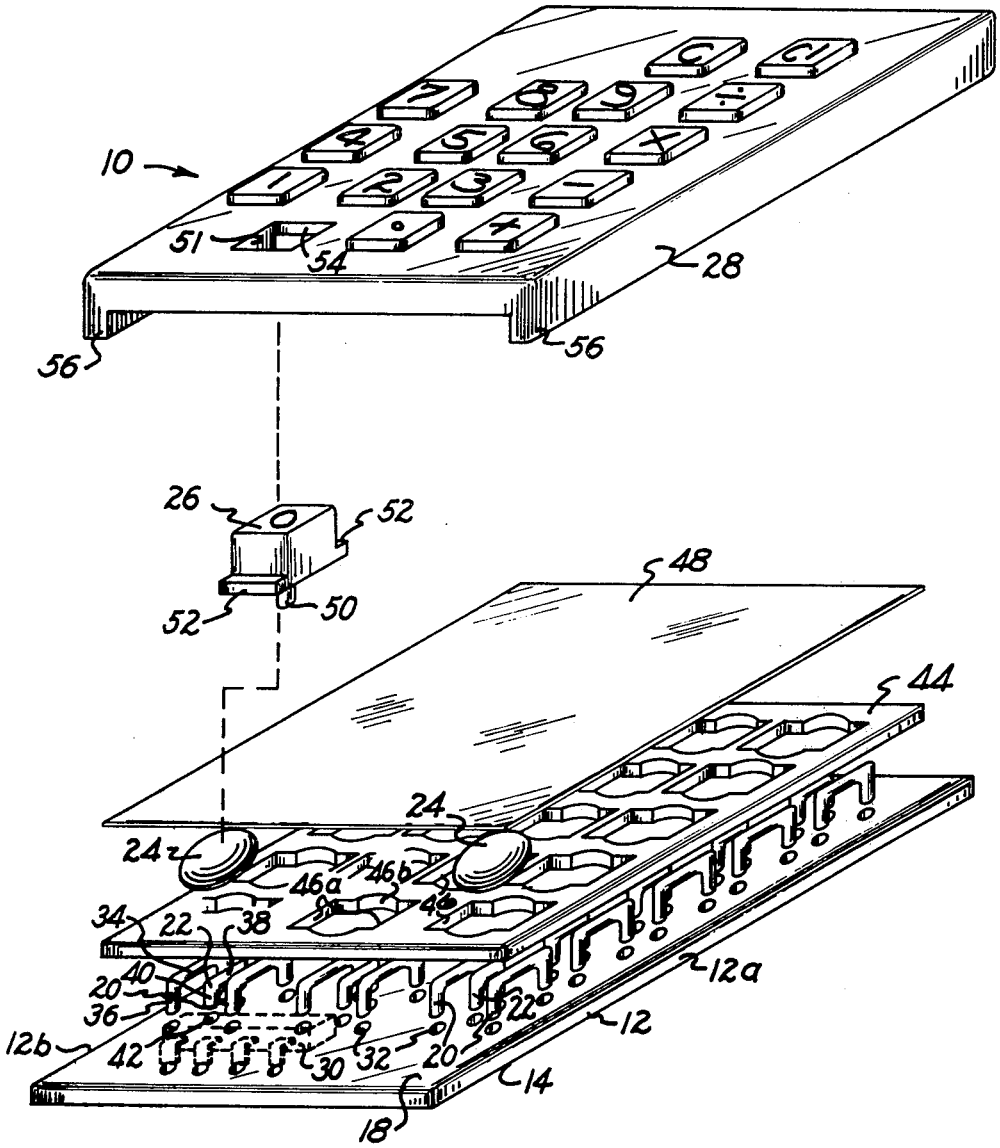
FIG. 1 is an exploded perspective view illustrating a preferred embodiment of a keyboard system in accordance with the present invention.
Figure 2:
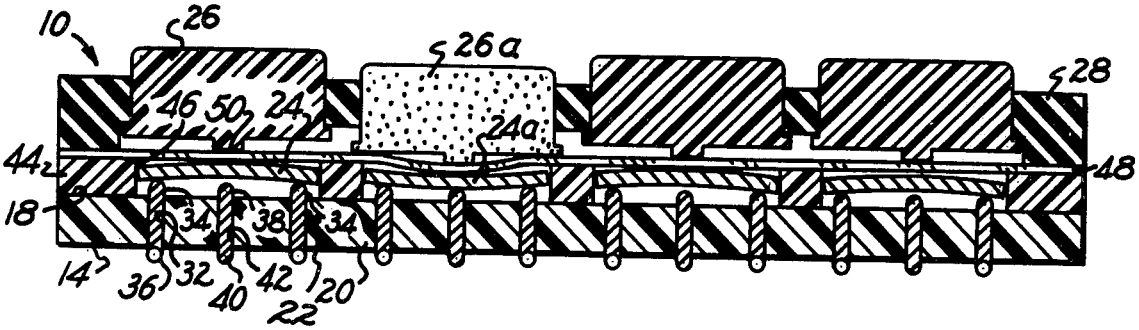
FIG. 2 is a vertical sectional view through the keyboard system illustrated in FIG. 1.
Figure 3:
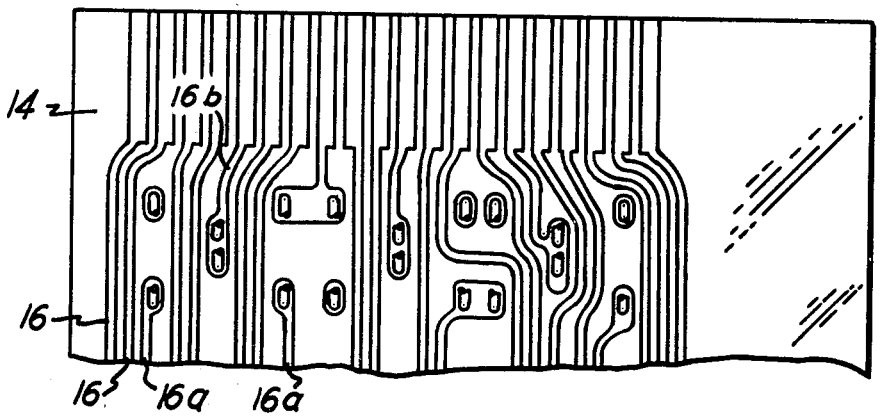
FIG. 3 is a partial plan view of the underside of the system illustrated in FIG. 2.

Referring generally to the drawings, wherein corresponding elements in the various views are indicated by common reference numerals, and in particular initially to FIGS. 1–3, a keyboard system 10 in accordance with the present invention is illustrated. The system generally includes a non-conductive or insulating support member 12 having a generally planar first surface 14 on which a plurality of conductive paths 16 are disposed and arranged in a preselected pattern for transmitting electrical information in response to selective interconnection of portions thereof. At a second opposite surface 18 of the insulating support member 12 a plurality of sets 20 of conductive support members are provided which are arranged in a preselected configuration in electrical communication with first preselected portions **16*a* of the conductive paths 16. Associated with each of the conductive support members are conductive contact members 22 similarly arranged at the second surface 18 of the insulating supporting layer in electrically isolated relationship with the conductive support members and in electrical communication with second preselected portions 16*b* of the conductive paths 16. A plurality of selectively actuatable conductive elements 24 are also arranged adjacent the second surface 18 of the insulating support layer and are respectively supported by and maintained in continuous electrical contact with each of the sets 20 of conductive support members and in selective disengagement with the associated conductive contact members 22. The conductive elements 24 are adapted to be deflected into a position of engagement with the conductive contact members 22 in response to the application of a preselected deflecting force thereto so as to establish a bridging electrical contact between one of the sets 20 of conductive support members and its associated conductive contact member 22, thereby electrically connecting the first and second preselected portions 16*a*, 16*b* of the conductive paths 16. Actuation of the conductive elements 24 so as to effect the establishment of the aformentioned bridging electrical connection may be effected in various ways, but in the illustrated embodiment it is accomplished by the provision of a plurality of manually actuatable pushbutton members 26 which are carried in a suitable casing 28 supported adjacent the second surface 18 of the insulating support member 12 whereby the application of a preselected deflecting force to the conductive elements 24 is effected by actuation of a selected pushbutton member 26 by the application of a mechanical force thereto such as through the fingertips of an operator. As a result of manual actuation of a selected pushbutton member 26 the preselected deflecting force is applied to the conductive element to effect deflection thereof into a position of engagement with the conductive contact member 22, thereby establishing the bridging electrical connection between the set of conductive support members 20 and the conductive contact member 22 and hence establishing an electrical connection between the first and second preselected portions 16***a*, 16*b* respectively of the conductive paths 16. In addition, if desired, a suitable device such as an integrated circuit shown in phantom and indicated generally by the reference numeral 30 may be carried by the insulating support member 12 and suitably connected to selected portions of the conductive paths 16 so as to process the signals established by the interconnection of various portions of the conductive paths. in response to the establishment of the bridging electrical connections. Similarly, if desired, a power supply (not shown) may be also carried on the support member 12 to provide a self-contained composite unit, or an external source of power may be utilized as the sole source of power or as an additional or alternative energy source.

More particularly, the insulating support member 12 is fabricated of a relatively rigid, non-conductive material which is adapted to provide support for the keyboard system, as well as associated electronic circuitry, power supplies, display means, etc. when the unit is to be incorporated in an electronic calculator system, a computer input system, etc. In this regard the member 12 may be fabricated of a suitable, relatively rigid, insulation material such as epoxy bonded glass cloth generally sold under the trade description G-10 by the Formica Company. The material may have a thickness of approximately 1/16th inch which has been generally found sufficient to provide adequate mechanical strength for a miniaturized device of this nature. As previously mentioned, the conductive paths 16 including the first and second preselected portions thereof 16*a*, 156*b* respectively are arranged in a desired pattern at the first surface 14 (the underside of the support member 12, as illustrated in FIG. 12) in order to permit the transmission of electrical information in response to selective interconnection of various portions of the conductive paths upon the establishment of the bridging electrical connections. The pattern of conductive paths may be deposited on the surface 14 of the support layer utilizing conventional printed circuit art techniques, such as masking, etching, engraving etc. In addition, a plurality of apertures 32 are provided extending through the thickness of the support member 12 between the first surface 14 and the second surface 18 thereof so as to permit the selective establishment of electrical communication between the conductive paths at the surface 14 and the conductive support members 20 and contact members 22 arranged at the opposite surface 18. In this regard the apertures may be provided prior to or subsequent to the deposition of the conductive paths, thereby providing a prepunched support board prepared for further fabrication operations.

In the illustrated embodiment the sets of conductive support members 20 are arranged to define a plurality of spaced sets of pairs of generally U-shaped, conductive members preferably comprising staples arranged at the surface 18 of the support layer 12. Such an arrangement has been found to be extremely advantageous in achieving enhanced ease of fabrication of the system since the staples may be readily inserted through the apertures 32 in the pre-punched support member 12 utilizing suitable high-speed automated stapling equipment. Similarly, electrical communication may be conveniently established between these staples and selected portions of the conductive paths 16. As shown, the staples 20 each include a main body portion 34 of a generally looped configuration terminating in a pair of legs 36 which are received within the apertures 32 in the support layer 12. The apertures 32 are of a size sufficient to accommodate the legs 36 in a close-fitting relationship, while the outer ends of the legs are crimped against the surface 14 and are in contact with the selected portions of the conductive paths 16, such as the first preselected portions 16*a*. Consequently, a rigid mechanical connection is established and the electrical contact may be improved by soldering the crimped portions of the legs into position. In addition, as shown, the main body portion 34 of each of the staples comprising the plurality of sets of support members projects a first preselected distance outwardly from the surface 18 of the support member 12 so as to define conductive support areas spaced from the surface 18 for carrying the conductive elements 24. Similarly, the associated conductive contact members 22 are also illustrated as generally U-shaped conductive members, preferably comprising staples each having a main body portion 38 which terminates in a pair of legs 40 which project through apertures 42 extending through the thickness of the support member 12 similarly to the apertures 32, but providing communication with other portions of the conductive paths 16, such as the second preselected portions 16*b*. The legs 40 extend through the apertures 42 with the outer ends thereof being crimped against the surface 14 of the support layer 12 preferably in contact with other portions of the conductive paths 16, such as the second preselected portions 16*b*. The apertures 42 are of a size sufficient to accommodate the legs 40 of the staple 22 while the outer ends of the legs 40 are crimped against the surface 14 in contact with the second preselected portions 16*b* of the conductive paths to rigidly secure the staple to the member 12. In addition, the outer ends of the legs 40 crimped in position against the second preselected portions 16*b* of the conductive paths 16 may be soldered in this position to provide an improved electrical contact as shown. One of the contact staples 22 is arranged intermediate each of the pairs of support staples 20 and may be of a slightly smaller gauge such that its main body portion 38 projects outwardly from the surface 18 a second preselected distance different than the first preselected distance which the body portion 34 of the support staples 20 projects from the surface so as to facilitate maintenance of selective disengagement between the conductive elements 24 and the contact staples 22, as will be subsequently explained. The conductive support staples 20 and the conductive contact staples may be fabricated of various materials and material combinations depending upon the properties desired. For example, in one preferred embodiment the staples are fabricated of gold-plated nickel wire in order to provide a relatively non-reactive material having good surface contact properties. As other examples, the staples may be fabricated of gold-plated stainless with a flash of nickel intermediate the stainless steel core and the gold plating, or of beryllium copper.

The conductive elements 24 preferably comprise a plurality of generally circular, disc shaped elements formed of a segment of a hollow body having a double curved outer surface such as a segment of an oblique spheroid and are each illustrated as including a generally convex surface of curvature when in an unactuated or rest state which is in facing relationship with the pushbutton members 26. The element 24 is selected such that it has an overcenter position when its central portion is subjected to a preselected deflecting force while automatically returning to its original position upon removal of the force, whereby the element is provided with a memory function. Of course, segments of other hollow bodies having double curved surfaces may be utilized in providing the conductive elements. The element 24 may be arranged such that it undergoes a snap-action deflection into its overcenter position in order to establish the aforementioned bridging electrical contact. In this regard referring particularly to FIG. 2, one of the elements indicated by the numeral 24*a* is shown in its overcenter position in response to actuation by a depressed pushbutton member indicated by reference numeral 26*a*. However, it should be noted that in certain instances the central portion of conductive element 24 may be sufficiently closely spaced to the contact staple 22 that the element 24 need not be completely deflected into its overcenter position in order to contact the staple 22 for establishing the requisite bridging contact. Thus, upon application of the preselected deflecting force to the central portion of the conductive element 24 in response to actuation or depression of the pushbutton member 26 the element 24 is caused to undergo a snap-action deflection into its overcenter position. In addition, as a result of this snap-action deflection a tactile feed-back is provided which may be sensed in the finger tips of the operator actuating a particular pushbutton. Furthermore, an audible acknowledgement of deflection may accompany the snap-action deflection which may be further sensed by the operator as an additional indication of actuation of a pushbutton member to transmit a desired electrical signal. The conductive elements 24 preferably comprise gold-plated stainless steel discs and in one preferred embodiment may be fabricated of A.I.S.I. (American Iron and Steel Institute) Type 302 Stainless Steel, which comprises by weight approximately 0.15% carbon, 2.00% (max.) manganese, 1.00% (max.) silicon, 17% to 19% chromium, 8% to 10% nickel and the balance iron, with a thin gold plating over its exposed contact surfaces.

Each of the conductive elements 24 is maintained in axial registry with the conductive contact staple 22 associated with each of the sets of support staples 20 with the central portion thereof spaced from the contact staple 22. The marginal edges of the conductive elements 24 are supported on the main body portions 34 of the support staples 20 of each set such that the conductive element 24 is in continuous electrical contact therewith and hence with the first preselected portions 16*a* of the conductive paths 16. Similarly, the central portion of the conductive elements 24 which are in registry with the main body portions 38 of the contact staples 22 remain in selective disengagement with the contact staples until deflected by actuation of a pushbutton member 26, whereupon the briding electrical connection is established between a set of conductive support staples 20 and its associated conductive contact staple 22 and hence between the first and second preselected portions 16*a*, 16*b* of the conductive path 16.

In order to further support each of the conductive elements 24 and provide lateral restraint therefor a carrier sheet of insulating material 44 is disposed adjacent the surface 18 of the support member 12 overlying the plurality of sets of conductive support staples 20 and associated conductive contact staples 22. The sheet 44 includes plurality of apertures 46 which are of a size sufficient to accommodate the conductive elements 24 therein and arranged in registry with the plurality of sets of conductive support staples 20 and the associated conductive contact staples 22. More particularly, the conductive elements 24 are disposed within the apertures 46, which are of a size slightly larger than the spacing intermediate the staples comprising each of the sets of conductive support staples. Accordingly the sheet 44 may be maintained essentially in abuttment with the surface 18 of the support member 12 with the main body portions 34 of the conductive support staples 20 which support the elements 24 extending slightly into the apertures 46. The conductive elements 24 are arranged within the apertures 46 and have opposed marginal portions resting on the main body portions 34 of the conductive support staples 20. Thus, support, as well as lateral restraint for the conductive elements 24 is provided. In addition, as may be noted, particularly in FIG. 1, each of the apertures 46 is of a preselected shape including a pair of opposed parallel walls 46*a* which are of a generally straight-line configuration, these generally straight-line wall portions being arranged to bound the main body portions 34 of the conductive support staples 20 which extend into the apertures 46. The other pair of opposed wall portions 46*b* of each of the apertures 46 are arranged in a generally curvilinear configuration curving outwardly from the center of the apertures 46 so as to more efficiently accommodate the generally circular conductive elements or discs 24. In this regard by virtue of providing the apertures 46 having a shape as illustrated certain advantages are achieved in that the overall space occupied by the apertures is minimized, since only one of the two dimensions of the apertures are increased while the other dimension is minimized, thereby maximizing the amount of material which remains to define the layer 44 in order to enhance its structural strength and rigidity. This is advantageous in view of the small size of the layer 44 and the large number of apertures which are employed. The sheet 44 may be fabricated of a suitable non-conductive material such as a suitable glass cloth reinforced epoxy. In addition, the marginal portions of the sheet 44 which extend beyond the sets of support staples 20 at opposed sides of the support board 12 preferably are bonded or sealed to the marginal portions of support member 12 so as to facilitate the formation of an environmentally sealed unit.

In certain instances, it has been found desirable to further restrain the conductive elements 24 in their respective positions by providing a relatively thin, flexible sheet or film of an insulating force transmitting over-layer sheet or film 48, as shown, which is arranged intermediate the sheet 44 and the casing 28 which supports the pushbutton members 26. The over-layer 48 may comprise a material, such as polyethylene terephthalate, commonly sold under the trade name Mylar, and may be suitably bonded or sealed to the exposed surface of the layer 44 and hence functions to prevent the conductive elements 24 from inadvertently being removed or falling from their desired positions within the apertures 46, as well as completing an environmental seal for the unit.

The pushbutton members 26 are each appropriately symbolized at their outer exposed surfaces in a manner indicative of the electronic function associated with actuation of a selected pushbutton member which establishes the requisite briding electrical connection between the conductive support staples 20 and the conductive contact staple 22 and hence between the first and second preselected portions 16*a*, 16*b* of the conductive paths 16. In addition, each of the pushbutton members includes an opposed protruding surface portion 50 which depends from the main body thereof and is maintained in abuttment with the generally central region of the conductive element 24 and is adapted to apply the requisite deflecting force thereto in response to actuation of the pushbutton member. Each of the pushbutton members 26 is preferably fabricated of a relatively rigid non-conductive plastic material, and is supportingly carried within the support casing 28 which includes a plurality of slots 51 for accommodating the body of the members 26. The casing 28 may be similarly fabricated of a suitable rigid, non-conductive plastic material, or the like. In this regard each of the pushbutton members 26 include a flanged portion 52 which integrally extends from one pair of opposed lower edge surfaces thereof. These flange portions 52 are adapted to be received within accommodating channels or slots 54 in the casing 28 when the members 26 are positioned in the casing 28 to preclude lateral motion of the pushbutton elements 26 within the casing, while permitting movement of the pushbutton members normal to the planar surface of the casing 28 upon actuation thereof. In addition, the casing 28 includes a pair of depending flange members 56 the spacing therebetween being of a size sufficient to accommodate the marginal edge portions 12*a*, 12*b* of the support member 12 if it is desired to provide an environmental seal between these marginal edge portions 12*a*, 12*b* and the inner surfaces of the flange members 56, when the casing 28 is positioned in abuttment with the overlayer sheet 48 with the pushbutton members aligned with the respective conductive elements 24. Thus, in operation the pushbutton members are precluded from lateral movement within the casing but are permitted to be moved from a retracted to an actuating position in response to application of a mechanical force to be exposed surfaces thereof so as to effect deflection of an associated conductive element 24. Accordingly, upon actuation of a selected pushbutton member the conductive element 24 is caused to execute a snap-action deflection into its over-center position in which it is in engagement with one of the associated contact staples 22, as well as with the set of supporting staples 20, establishing a bridging electrical contact between the contact staple 22 and the set of support staples 20 associated therewith.

Figure 4:
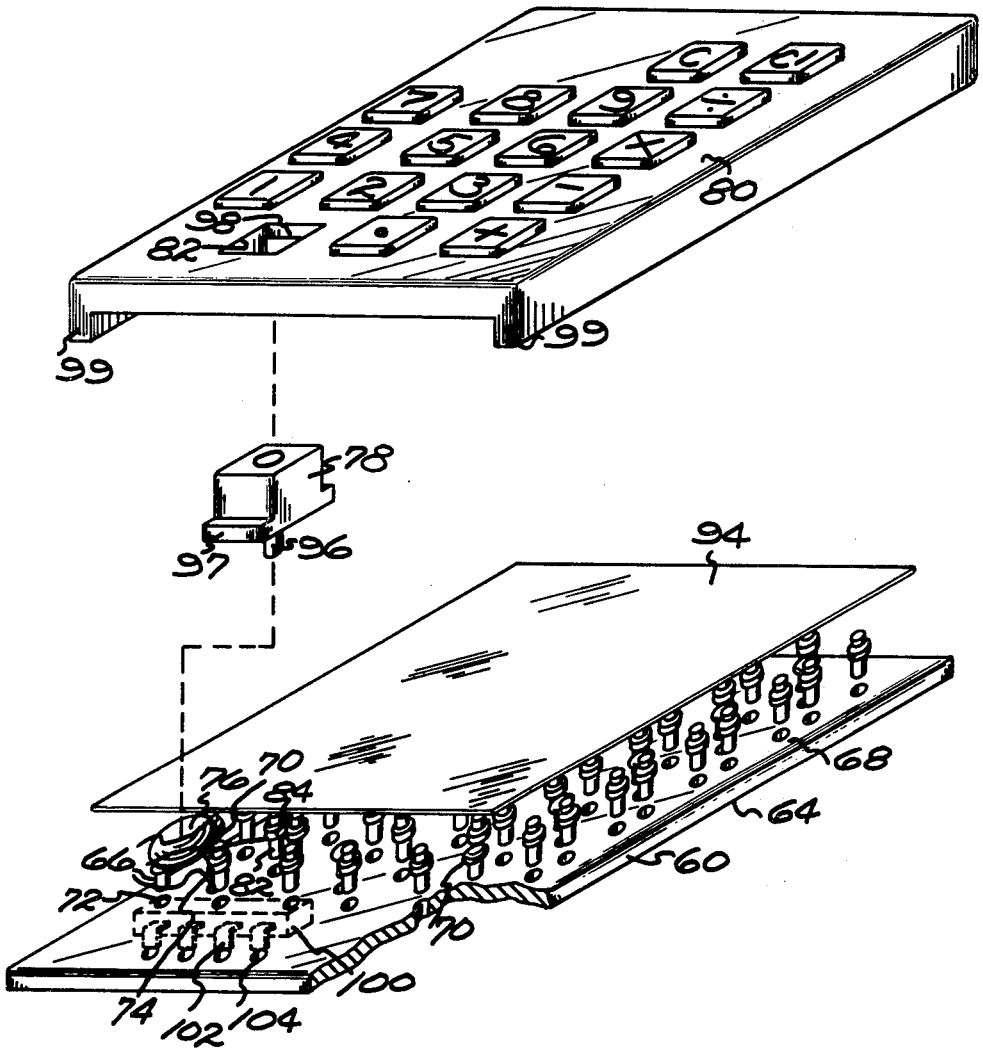
FIG. 4 is an exploded perspective view of an alternative embodiment of a keyboard system similar to that illustrated in FIG. 1.
Figure 5:
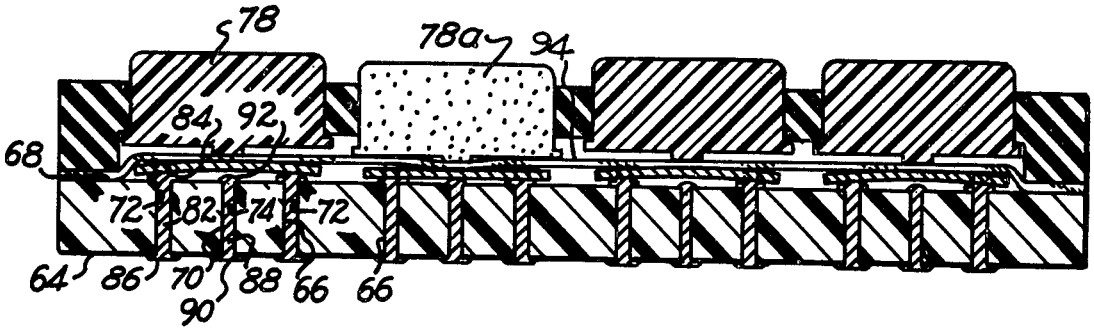
FIG. 5 is a vertical sectional view through the keyboard system illustrated in FIG. 4.
Figure 6:
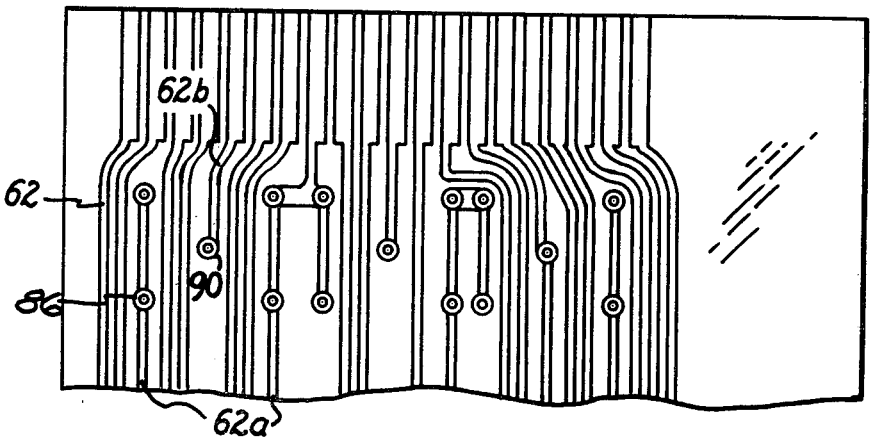
FIG. 6 is a plan view of the underside of the system illustrated in FIG. 5.

Referring now to FIGS. 4–6 an alternate embodiment of a keyboard system similar to that illustrated in FIGS. 1–3 is shown in which a modified arrangement for carrying the conductive elements is provided. More particularly, in this embodiment a support member of insulating material similar to the support member 12 is provided having a preselected pattern of conductive paths 62 arranged at a first surface 64 thereof while a plurality of sets of conductive support members 66 are arranged at a second opposed surface 68 of the board with an associated conductive contact member 70 being provided associated with each of the sets of conductive support members spaced from and electrically isolated from the set of support members. The conductive support members 66 are adapted to be disposed in cooperating apertures 72 which are provided extending through the thickness of the support board 60 between the first and second surfaces 64, 68 so as to permit electrical communication to be established between each set of conductive support members 66 and first preselected portions 62*a* of the conductive paths 62, when these conductive support members are inserted within the apertures 72 while a plurality of additional apertures 74 similarly extend through the thickness of the support member 60 for accommodating the associated conductive contact members 70, the apertures 74 permitting electrical communication to be established between the conductive contact members 70 and second preselected portions 62*b* of the conductive paths 62, when the conductive contact members 70 are inserted within the respective apertures. Each of the sets of conductive support members 66 is adapted to define a generally planar support area for supportingly receiving a conductive element 76 similar to the conductive element 24. The conductive element 76 is supported in continuous electrical contact with the set of support member 66 and hence in contact with the first preselected portions 62*a* of the conductive paths 62. In addition the conductive element 76 remains in selective disengagement with the associated conductive contact member 70 and accordingly, each set of support members remains electrically isolated from its associated contact member 70 until deflection of the conductive element 76 is effected. Such deflection is accomplished in a manner similar to that described in connection with the preceding embodiment in response to the application of a preselected deflecting force to the conductive element 76 to establish engagement between the conductive element 76 and the conductive contact member 70, thereby establishing a bridging electrical contact between the set of conductive support members 66 and the conductive contact member 70 and hence between the first and preselected portions 62*a*, 62*b* of the conductive paths 62. The application of the preselected deflecting force to the conductive element 76 is again accomplished by the provision of a plurality of pushbutton members 78 maintained in registry with the respective conductive elements 76 such that actuation or depression of a pushbutton member 78 is effective to cause deflection of a conductive element in order to cause it to engage its associated conductive contact member thereby establishing the requisite bridging electrical contact. The pushbutton members 78 are similarly carried within a suitable support casing 80 which includes a plurality of slots 82 for receiving the body of the pushbutton members 78 therein, the pushbutton members being movable from a retracted to an actuating position in response to the application of a mechanical force to the exposed surfaces thereof, such as by manual actuation.

As previously mentioned, in accordance with an important advantage of the present invention a keyboard system is provided which is particularly suitable for fabrication by rapid, accurate, and inexpensive mass production techniques. The embodiment illustrated in FIGS. 4–6 similarly provides such advantages in that the support board 60 may be similarly provided in a prepunched configuration including the apertures 72, 74 for accommodating the conductive support members and the conductive contact members, while a desired pattern of conductive paths may be deposited on the surface 64 thereof utilizing conventional printed circuit art techniques to permit the selected electrical connections to be made between respective portions of the conductive paths. However, rather than employing staples, as in the preceding embodiment each of the sets of conductive support members 66 preferably comprises a plurality of collared rivets each of which includes a shank 82 and a flanged collar 84 with the shank adapted to be inserted in the aperture 72 while the collar 84 rests against the surface 88 of the support board, a portion of the shank projecting outwardly therefrom and the opposite end 86 of the shank is crimped against the surface 64 of the support member 60 in electrical contact with the first preselected portions 62*a* of the conductive path 62, thereby mechanically restraining the rivet in position with respect to the support member and the conductive path 62. In addition the crimped end 86 may be soldered in position to assure a good electrical contact with the first preselected conductive path 62*a*. In the illustrated embodiment each set 66 includes four of the previously described rivets arranged to define a generally enclosed area with the flanged collar portions 84 of each of the rivets defining a generally planar support area for the conductive element 76. It should be noted that a lesser or greater number of rivets, of course, may be utilized. In addition, the associated conductive contact member 70 is arranged generally centrally within the area defined by the four rivets 66 and preferably comprises a headed rivet including a shank portion 88 which is disposed within the aperture 74 with one end 90 being crimped against the surface 64 of the support board 60 as shown while its opposite end terminates in a head 92 of a larger diameter than the aperture 74 such that the rivet 70 is mechanically restrained with respect to the support member 60, subsequent to the crimping of its end 90 against the surface 64. The crimped end 90 is in electrical contact with the second preselected conductive path 62*b* and similarly may be soldered in position to assure a good electrical contact therewith. In addition, as shown the head 92 of the rivet 70 may be displaced outwardly from the surface 68 of the support member 60 a lesser distance than the collar 84 of the support rivets 66 such that the central portion of the conductive element 76 may be maintained in selective disengagement therewith, as will now be explained in detail.

More particularly, the conductive elements 76 are generally similar to the elements 24, as described in connection with the embodiment illustrated in FIGS. 1-3. The element 76 is arranged such that it similarly undergoes deflection movement into its overcenter position in order to establish the aforementioned bridging electrical contact between the set of support rivets 66 and the contact rivet 70 and hence between the first and second preselected portions 62*a*, 62*b* of the conductive paths. In this regard the marginal portions of the element 76 are supported by and rest upon the flanged collar portion 84 of the support rivets 66 such that the element 76 is maintained in constant electrical contact with the set of support rivets 66 while its central portion remains in selective disengagement with the head 92 of the contact rivet 70. Upon application of a preselected deflecting force to the central portion of the conductive element 76 in response to actuation or depression of the selected pushbutton member 78 the element 76 is caused to undergo a snap-action deflection into its overcenter position and engages the head 92 of the contact rivet 70 thereby establishing an abrupt, instantaneous and positive bridging electrical contact between the support rivets 66 and the contact rivet 70 and hence between the first and second preselected portions 62*a*, 62*b* of the conductive paths 62. In addition, similarly to the preceding embodiment, as a result of this snap-action deflection a tactile feed-back is provided which may be sensed in the finger tips of the operator actuating a particular push-button, and an audible acknowledgement of deflection may accompany the snap-action deflection and may be further sensed by the operator as an additional indication of actuation of a pushbutton member to transmit a desired electrical signal.

In order to further aid in maintaining the elements 76 in position as well as to facilitate the formation of an environmental seal, it has been found advantageous in certain instances to provide an overlayer 94 of a flexible force transmitting material arranged intermediate the pushbutton members 78 and the conductive elements 76. In this regard lateral movement of the conductive elements 76 is precluded by virtue of the disposition of the elements 76 within the area defined by each of the sets of support rivets 66 resting on the flanged collar portions 84, with the marginal edges of the conductive elements 76 being laterally restrained by the portions of the shanks 82 which project outwardly beyond the collars 84. However, in order to prevent the elements 76 from being inadvertently removed from or falling from the unit the overlayer 94 may be provided, as shown, and may be suitably bonded to the marginal edge portions of the support board 60 to form an environmental seal. The overlayer 94 may be fabricated of a strong, flexible, thin insulation material, such as polyetheylene terephthalate, commonly sold under the trade name Mylar.

As previously mentioned, the pushbutton elements 78 are suitably carried within the slots 82 in the casing 80 and as shown have outer exposed surfaces which are appropriately symbolized in accordance with the electrical information which is to be transmitted in response to actuation thereof. In addition, a generally centrally located protruding member 96 extends from the opposed surfaces of each of the pushbutton members and is arranged in axial registry with the central portions of each of the conductive elements 76 so as to apply the preselective deflecting force thereto in response to actuation or depression of the pushbutton members 78. A pushbutton member 78*a* is illustrated in FIG. 5 in its depressed or actuated condition to show the establishment of the bridging electrical contact between the set of conductive support rivets 66 and the conductive contact rivet 70, whereby the requisite bridging electrical contact is established between selected portions of the conductive paths 62. Each of the pushbutton members 78, similar to the preceding embodiment, also may include a pair of opposed flanges 97 which are adapted to be received in cooperating channels 98 in the wall of the slots 82 in the casing to provide improved lateral support for the pushbutton members 76. The casing 80 also preferably includes a pair of depending flange portions 99 extending along its longitudinal edges spaced apart a distance slightly greater than the lateral dimension of the support member 60 so that the inner portions of the flanges 99 may be sealed to the marginal edges of the support member 60 if it is desired to provide an environmentally sealed unit. The casing 80 as well as the pushbutton members 78 may be fabricated of a suitable insulating plastic material.

In operation it may be seen that similarly to the embodiment illustrated in FIGS. 1–3 the actuation or depression of a selected pushbutton member 78 effects deflection of its associated conductive element 76 so as to effect the establishment of the bridging electrical contact between the support rivets 66 and the contact rivet 70 and hence between the first and second preselected portion 62*a*, 62*b* of the conductive paths 62 so as to permit the transmission of an appropriate electrical signal. In addition, as illustrated in FIG. 6, if desired, suitable semiconductor devices or the like illustrated in phantom as a dual-in-line package integrated circuit 100 may be provided with its lead members 102 extending through suitable apertures 104 in the support board 60 and maintained in contact with requisite portions of the conductive paths 62 so as to selective couple the various circuit elements thereof (not shown) to the paths 62 in order to process the electronic information being transmitted upon interconnection of selected portions of the conductive paths. Similarly, if desired, a suitable power supply means (not shown) may be also mounted on the support member 60.

Figure 7:
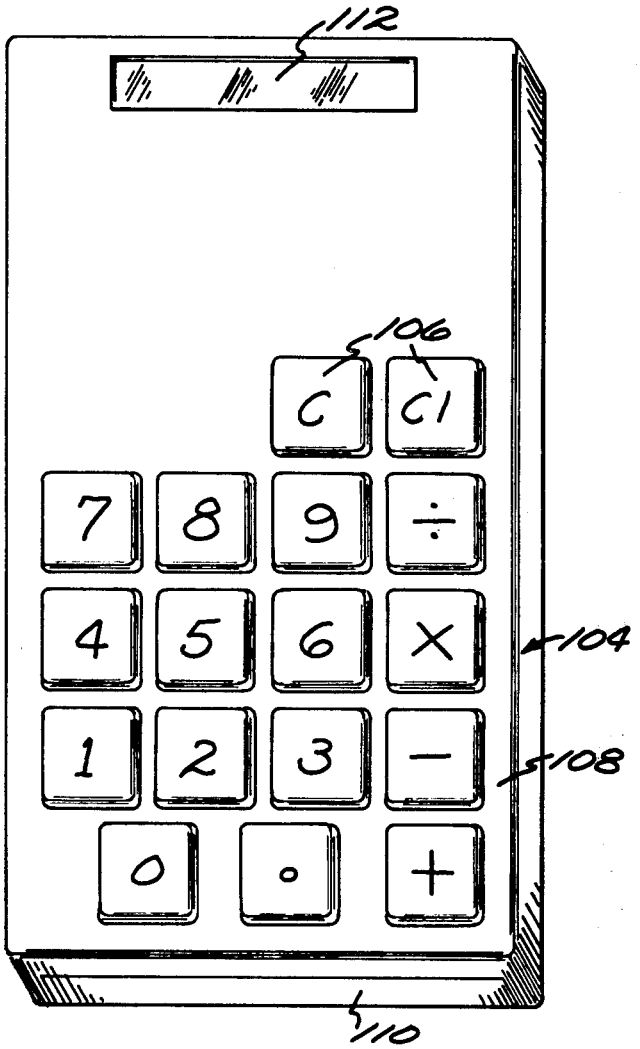
FIG. 7 is a perspective view illustrating a typical variety of electronic calculator incorporating a keyboard system such as that illustrated in the preceding embodiments.

Referring to the FIG. 7 embodiment a composite unit indicated generally by the reference numeral 104 is illustrated, including a plurality of pushbutton members 106 supported within a casing 108 which is mounted in overlying relationship with a support board 110 which may include conductive support areas, conductive contact areas, conductive elements, conductive paths etc., all as shown and described in the preceding embodiments. In addition, the unit 104 includes a visual display window 112 so as to provide a visual indication of operation of the unit when it is being utilized as an electronic calculator, for example, as an input to a computer system, etc. Similarly, if desired, the unit 104 may include a suitable print out mechanism to provide a permanent record, if desired.

Thus, a unique keyboard system has been described in detail in which a particularly advantageous bridging electrical contact system is provided the system being particularly adapted for incorporation in various systems such as electronic calculators, computer systems, etc.

Various changes and modifications in the above-described embodiments will be readily apparent to those skilled in the art and any of such changes or modifications are deemed to be within the spirit and scope of the present invention as set forth in the appended claims.

I claim:

1. A keyboard having a plurality of normally open contact switches, said keyboard comprising:

a circuit board having first and second sides;

a plurality of spaced first electrical contacts, each contact extending through said circuit board from said first side of said circuit board to said second side thereof and being electrically connected to selective circuits on said second side;

a plurality of second contacts, each formed as a curved resilient plate of electrically conductive material spaced from said first contact in a normally open position and having a peripheral edge along at least a portion of which said second contact is supported;

a contact support on said first side of said circuit board spaced from each of said first contacts and supporting said second contacts along at least a portion of their peripheral edges, said contact support being connectable to a potential, each of said switches completing a circuit upon deflection of the center of said plate from said normally open position to a closed position against a corresponding first contact when pressure is exerted against said center, said center snapping back to said normally open position upon removal of said pressure;

an insulative element covering said first side of said circuit board to hold said second contacts in position with respect to said first contacts and to keep foreign material out of said contacts, said element including a layer of thin flexible material completely covering said second contacts;

a plurality of depressible keys; and means for positioning said keys with one of said keys adjacent each of said second contacts with said layer of flexible material therebetween, each of said keys being selectively depressible to deflect a respective plate from said normally open position to a closed position.

2. A keyboard, as claimed in claim 1, wherein:

each of said first contacts is a rivet.

3. A keyboard, as claimed in claim 1, wherein said insulative element further includes:

spacer means positioned about the periphery of said second contacts to hold said second contacts so that the centers thereof are in substantial alignment with said first contacts.

* * * * *